US010930455B2

(12) United States Patent
Fehl et al.

(10) Patent No.: US 10,930,455 B2
(45) Date of Patent: Feb. 23, 2021

(54) SWITCH BASED CONTROL OF LIGHTING FIXTURE INTEGRATED DEVICE

(71) Applicant: SIGNIFY HOLDING B.V., Eindhoven (NL)

(72) Inventors: Peter Jepson Fehl, Decatur, GA (US); Nam Chin Cho, Peachtree City, GA (US); Parth Joshi, Sugarhill, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 209 days.

(21) Appl. No.: 16/142,622

(22) Filed: Sep. 26, 2018

(65) Prior Publication Data

US 2019/0096614 A1 Mar. 28, 2019

Related U.S. Application Data

(60) Provisional application No. 62/564,137, filed on Sep. 27, 2017.

(51) Int. Cl.

| | |
|---|---|
| ***H01H 47/00*** | (2006.01) |
| ***H05B 45/00*** | (2020.01) |
| ***H05B 47/19*** | (2020.01) |
| ***H05B 47/105*** | (2020.01) |

(52) U.S. Cl.

CPC ..... *H01H 47/001* (2013.01); *H05B 45/00* (2020.01); *H05B 47/105* (2020.01); *H05B 47/19* (2020.01); *H01H 2300/054* (2013.01)

(58) Field of Classification Search

CPC ..... H01H 47/001; H01H 2300/054; H05B 45/00; H05B 47/19; H05B 47/105

USPC ..... 307/38

See application file for complete search history.

*Primary Examiner* — Hal Kaplan

(74) *Attorney, Agent, or Firm* — Patrick T. Driscoll

(57) ABSTRACT

A lighting device includes a light source, an auxiliary device, and a control device configured to detect toggles of a switch that controls availability of an input power to the lighting device including the light source. The control device is configured to change an operation mode of the auxiliary device based on the toggles of the switch.

20 Claims, 11 Drawing Sheets

1000

SWITCH BASED CONTROL OF LIGHTING FIXTURE INTEGRATED DEVICE

CROSS REFERENCE TO RELATED APPLICATIONS

The present application claims priority under 35 U.S.C. Section 119(e) to U.S. Provisional Patent Application No. 62/564,137, filed Sep. 27, 2017 and titled "Switch Based Control Of Lighting Fixture Integrated Device," the entire content of which is incorporated herein by reference.

TECHNICAL FIELD

The present disclosure relates generally to lighting solutions, and more particularly to controlling a lighting fixture integrated device based on a light switch.

BACKGROUND

Some lighting fixtures may include one or more integrated devices such as a sensor. Devices that are integrated in lighting fixtures are often difficult to access. Lighting fixtures typically do not have an accessible button or another control structure to enable and disable or otherwise control certain integrated devices. Thus, physically accessing integrated devices to power on, power off, configure, change operation modes, etc. can be challenging. As more and more devices become integrated into lighting fixtures, the controllability of these integrated devices is becoming important. Thus, a solution that provides a convenient means of controlling devices integrated in a lighting fixture is desirable.

SUMMARY

The present disclosure relates generally to lighting solutions, and more particularly to controlling a lighting fixture integrated device based on a light switch. In an example embodiment, a lighting device includes a light source, an auxiliary device, and a control device configured to detect toggles of a switch that controls availability of an input power to the lighting device including the light source. The control device is configured to change an operation mode of the auxiliary device based on the toggles of the switch.

In another example embodiment, a method of controlling an auxiliary device of a lighting device includes detecting, by a control device of the lighting device, a toggle of a switch to an off-position. The method further includes determining, by the control device of the lighting device, whether the switch is toggled to the off-position within a threshold time period after being toggled to an on-position. The method also includes changing the operation mode of the auxiliary device in response to determining that the switch is toggled to the off-position within the threshold time period after being toggled the on-position.

In another example embodiment, a lighting system includes a first lighting device, a second lighting device, and a switch that controls a power provided to the first lighting device and the second lighting device. The first lighting device and the second lighting device each include a light source, an auxiliary device, and a control device configured to detect toggles of the switch. The control device is configured to change an operation mode of the auxiliary device based on the toggles of the switch.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
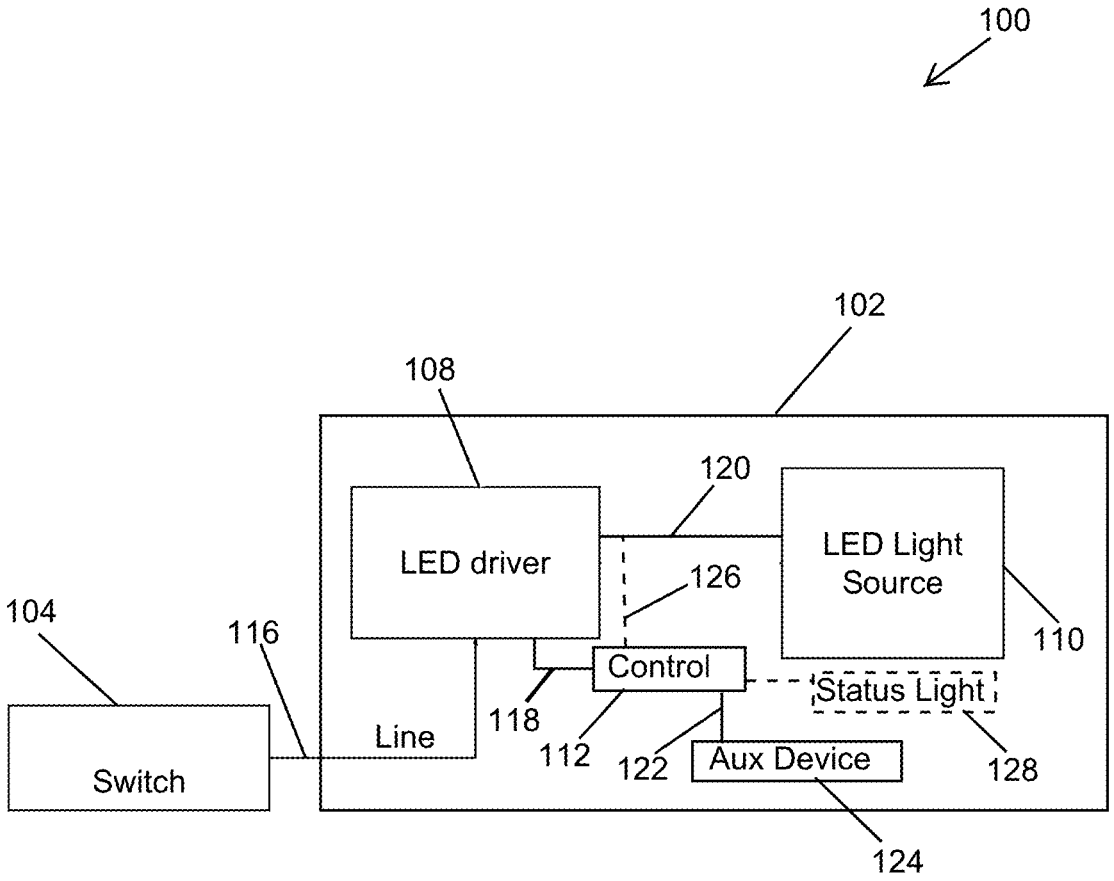
FIG. 1 illustrates a lighting system including a lighting device with an integrated auxiliary device controllable based on availability of power according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals with the same last two digits may designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

In some example embodiments, a solution that enables a lighting fixture to recall the last on-state of a light source of the lighting fixture and to invert the state upon a full toggle cycle of a switch that controls power to the lighting fixture is desirable. Such a solution provides a user the option to use the switch to control the power state of the lighting fixture while allowing wireless control of the lighting fixture.

Turning now to the figures, example embodiments are described. FIG. 1 illustrates a lighting system 100 including a lighting device 102 with an integrated auxiliary device 124 controllable based on availability of power according to an example embodiment. The system 100 includes a switch 104 that controls the availability of electrical power to the lighting device 102. For example, the lighting device 102 may be a recessed or another type of lighting device, and the switch 104 may control the availability of AC power from the power mains to the lighting device 102. To illustrate, the electrical power may be provided to the lighting device 102 via a line connection 116 when the switch 104 is in an on-position, and the electrical power is unavailable to the lighting device 102 when the switch 104 is in an off-position. For example, the line connection may include one or more electrical wires. The switch 104 may be a wall switch or another type of standalone switch or a switch integrated in another device, such as a wall station.

In some example embodiments, the lighting device 102 includes an LED driver 108, a control device 112, and a light source 110 that includes LEDs. The lighting device 102 may also include an auxiliary device 124. For example, the auxiliary device 124 may be a smart speaker, one or more standalone or integrated microphones, a video camera, a sensor (e.g., a motion sensor, a smoke detector, etc.), a wireless access point device, a wireless node device, etc.

In some example embodiments, the LED driver 108 may receive the electrical power via the line connection 116 when the switch 104 is in the on-position and may generate one or more output power signals from the received electrical power. For example, the LED driver 108 may generate one or more DC output power signals. An output power signal from the driver 108 may be provided to the light source 110 via an electrical connection 120, and another output power signal from the driver 108 may be provided to the control device 112 via an electrical connection 118 (e.g., one or more electrical wires). The electrical connections 118 and 120 may each include one or more electrical wires. In some alternative embodiments, the output power signal provided to the light source 110 may also be provided to the control device 112 via an electrical connection 126. For example, the electrical connection 118 may be omitted.

In some example embodiments, the control device 112 may control whether the auxiliary device 124 is turned on or off. For example, the auxiliary device 124 may be turned off even when the driver 108 receives input power via the connection 116 and generates an output power. For example, the light source 110 may be powered on while the auxiliary device 124 is off. To illustrate, the control device 112 may control whether the auxiliary device 124 is turned on or off by turning on or off the power provided to the auxiliary device 124 or by providing a control signal to the auxiliary device 124 indicating whether the auxiliary device 124 should be turned on or off. For example, an electrical connection 122 (e.g., one or more electrical wires) between the control device 112 and the auxiliary device 124 may be used to provide power from the driver 108 to the auxiliary device 124, where the control device 112 controls whether the power is available to the auxiliary device 124.

Alternatively or in addition, the control device 112 may provide a control signal to the auxiliary device 124 that controls whether the auxiliary device 124 is turned on or off when the power from the driver 108 is provided to the auxiliary device 124. For example, the auxiliary device 124 may include one or more standalone or device-integrated microphones, and the control device 112 may control whether the one or more microphones are turned on or off (or unmuted or muted). As another example, the auxiliary device 124 may be a smoke detector, and the control device 112 may control whether the smoke detector is turned on or off.

In some example embodiments, the control device 112 may control whether the auxiliary device 124 is turned on or off based on the availability of power from the driver 108 to the control device 112. Because the switch 104 controls the availability of input power to the driver 108 that provides power to the control device 112, the availability of power to the control device 112 depends on whether the switch 104 is toggled on (i.e., in an on-position) or off (i.e., in an off-position).

In some example embodiments, the control device 112 may control whether the auxiliary device 124 is turned on or off based on a detection of a particular sequence of toggles of the switch 104 including the time duration that the switch 104 remains in the on-position upon being toggled to the on-position. The control device 112 may determine the toggles of the switch 104 and the duration of time that the switch 104 stays in the on-position based on the availability and duration of the availability of power from the driver 108. For example, the control device 112 may detect when the power decreases reaching a particular level that indicates that the power is being turned off as can be understood by those of ordinary skill in the art with the benefit of this disclosure. The control device 112 may detect when the power increases reaching a particular level that indicates that the power is being turned on as can be understood by those of ordinary skill in the art with the benefit of this disclosure. The control device 112 may use a counter or similar hardware and/or software components to determine whether the power remains on for less than a threshold time period.

In some example embodiments, whether the control device 112 turns on or off the auxiliary device 124 when the power from the driver 108 becomes available after being unavailable may depend on the state of the auxiliary device 124 when the power from the driver 108 was previously available for a threshold time period. For example, the threshold time period may be 3 seconds, 5 seconds, etc. After input power has been provided to the driver 108, the switch 104 may be toggled off, resulting in the power from the driver 108 being turned off. When the power from the driver 108 becomes available again (i.e., the switch 104 is toggled back to the on-position providing input power to the driver 108), the control device 112 may determine whether the power remained available for at least a threshold time period or may determine the duration of time that the power remains available before it is turned off (i.e., before the switch is toggled off). The control device 112 may record whether the power remained available for at least the threshold time period or the duration of time that the power remained available.

If the power from the driver 108 remained available for less than the threshold time period (i.e., the switch 104 is toggled off within the threshold time period after being toggled on), when the power from the driver 108 becomes subsequently available, the control device 112 may turn off the auxiliary device 124, for example, if the auxiliary device 124 was previously powered on when the power was available for at least the threshold time period. If the power from the driver 108 remained available for less than the threshold time period and, for example, if the auxiliary device 124 was previously powered off when the power was available for at least the threshold time period, the control device 112 may turn on the auxiliary device 124 when the power from the driver 108 becomes subsequently available. In some alternative embodiments, the control device 112 may change the operation mode of the auxiliary device 124 to a different mode when the power from the driver 108 becomes subsequently available.

In some example embodiments, the control device 112 turns on or turns off or changes the operating mode of the auxiliary device 124 regardless of the state of the auxiliary device 124 when the power from the driver 108 was available for at least the threshold time period. Alternatively, as described above, whether the control device 112 turns on or off or changes the operating mode of the auxiliary device 124 when the power from the driver 108 becomes available may depend on the state of the auxiliary device 124 when power from the driver 108 was previously available for at least the threshold time period. For example, if the auxiliary device 124 was enabled when power was previously available for at least the threshold time period, the control device 112 may disable the auxiliary device 124 in response to detecting the particular sequence. If the auxiliary device 124 was disabled when power was previously available for at least the threshold time period, the control device 112 may enable the auxiliary device 124 in response to detecting the particular sequence.

As described above, the control device 112 may turn on and off the auxiliary device 124 by turning on and off the power provided to the auxiliary device 124 via the connection 122 or by providing a control signal to the auxiliary device 124 via the connection 122 or another connection. In some alternative embodiments, the control device 112 may turn on and off the auxiliary device 124 based on different sequences of toggles including different threshold time periods. For example, the control device 112 may turn on and off the auxiliary device 124 based on detecting toggling of the switch 104 to on and off multiple times, where each toggle to the off-position occurs within a threshold time period.

In some example embodiments, instead of or in addition to controlling whether the auxiliary device 124 is powered on and off, the control device 112 may control other operations of the auxiliary device 124 by providing one or more control signals to the auxiliary device 124 via the connection 122 or via another electrical connection. For example, based on the particular sequence of toggles of the switch 104 including time durations that the switch remains in the on-position or, equivalently, based the particular sequence of toggling of power and time durations that the power remains on, the control device 112 may control a particular mode of operation of the auxiliary device 124 other than on or off states of the auxiliary device 124. To illustrate, the auxiliary device 124 may be a smart speaker, and the control device 112 may set the auxiliary device 124 to operate in a first mode compliant with a first protocol (e.g., a protocol used by Amazon's Echo) or in a second protocol (e.g., a protocol used by Google Home) depending on a particular sequence of toggles of the power from the driver 108, which reflects the toggling sequence of the switch 104. The control device 112 may also mute and unmute and perform other configurations of the smart speaker based on the sequence of toggles of the power from the driver 108.

In some example embodiments, the lighting device 102 may include a status indicator light source 128 that emits one or more lights to indicate whether the auxiliary device 124 is turned on, off, in another operation mode, etc. In some alternative embodiments, the status indicator light source 128 may be integrated in the auxiliary device 124 and/or may be controlled by the auxiliary device 124.

By controlling the auxiliary device 124 based on the toggle sequence of the switch 104 that can be controlled by users, the control device 112 provides a convenient means to control of the auxiliary device 124. Users may use the switch 104 to control whether the auxiliary device 124 is powered on or off or other modes of operations of the auxiliary device 124.

In some alternative embodiments, the lighting device 102 may include more than one auxiliary device that may be controlled by the control device 112 in a similar manner as the auxiliary device 124. In some alternative embodiments, the lighting device 102 may include other components instead of or in addition to the components shown in FIG. 1. In some example embodiments, one or more components of the system 100 and/or the device 102 may be omitted or integrated without departing from the scope of this disclosure. In some alternative embodiments, the control device 112 may operate on power provided by a battery that may be included in or external to the lighting device 102.

Figure 2:
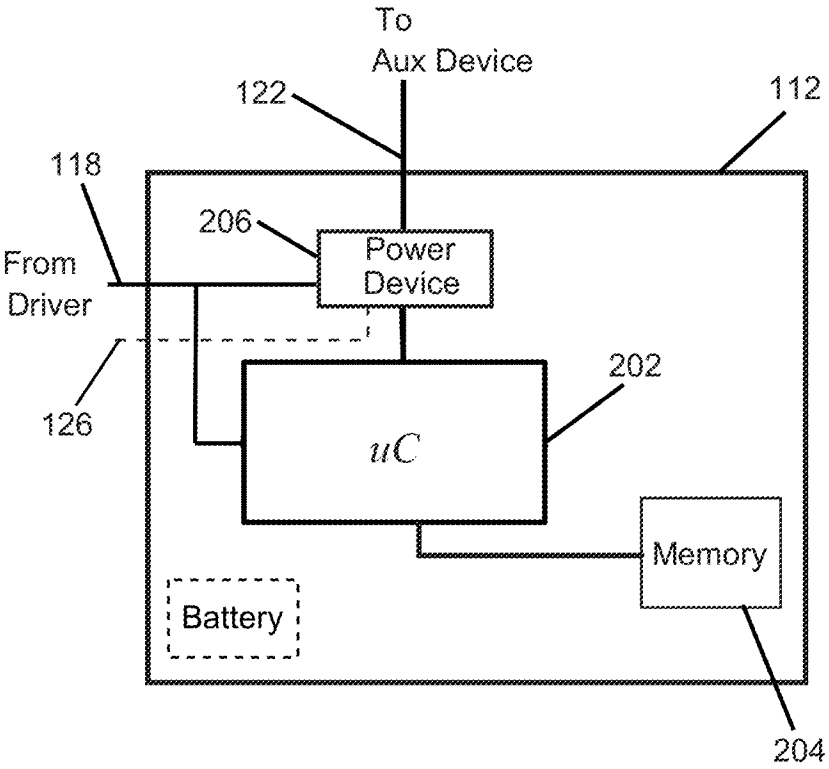
FIG. 2 illustrates the control device of the lighting device of FIG. 1 according to an example embodiment.

FIG. 2 illustrates the control device 112 of the lighting device 102 of FIG. 1 according to an example embodiment. Referring to FIGS. 1 and 2, the control device may include a controller 202 (e.g., a microcontroller), a non-volatile memory device 204 (e.g., an EEPROM or Flash memory), and a power device 206. For example, software code that is executable by the controller 202 may be stored in the memory device 204. The power device 206 may receive the output power from the driver 108 and provide the output power to the auxiliary device 124 under the control of the controller 202.

To illustrate, the controller 202 may detect a toggle of the switch 104 from a power-off position to a power-on position based on the output power (e.g., DC power) from the driver 108. For example, the controller 202 may include an analog-to-digital converter and may process the output of the analog-to-digital converter to determine when the switch 104 is toggled on.

In some example embodiments, the controller 202 may detect the toggling of the switch 104 to the on-position based on the output power provided to the controller 202 via the connection 118 or the connection 126. Upon detecting the toggling of the switch 104 to the on-position, the controller 202 may control the power device 206 to provide the output power to the auxiliary device 124 if the output power from the driver 108 was not provided to the auxiliary device 124 when the switch 104 was previously in the power-on position prior to being in the power-off position. For example, the controller 202 may store in the memory device 204 information, such as whether the output power was provided to the auxiliary device 124 when the switch 104 was previously toggled on, and subsequently retrieve the information from the memory device 204 to determine whether the output power from the driver 108 should be provided to the auxiliary device 124 upon the detection of the toggling on of the switch 104.

In some alternative embodiments, the power device 206 may be omitted or replaced by another component, and the controller 202 may provide one or more control signals to the auxiliary device 124 to turn on and off and/or control other operations (e.g., other operation modes) of the auxiliary device 124. In some alternative embodiments, the control device 112 may detect the toggle of the switch 104 based on the AC power provided via the connection 116.

Figure 3:
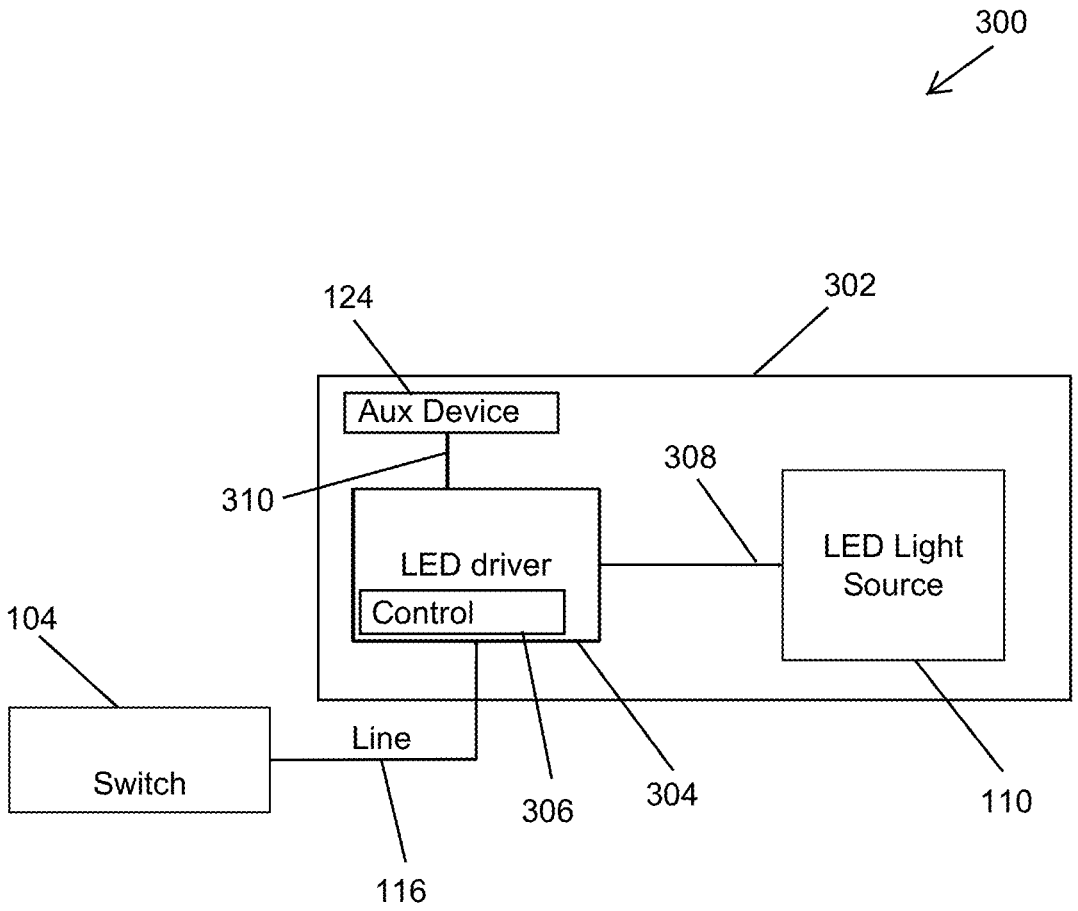
FIG. 3 illustrates a lighting system including a lighting device with an integrated auxiliary device controllable based on availability of power according to another example embodiment.

FIG. 3 illustrates a lighting system 300 including a lighting device 302 with the integrated auxiliary device 124 controllable based on availability of power according to another example embodiment. The system 300 also includes the switch 104, which may control the availability of electrical power (e.g., AC power from the mains power source) to the lighting device 302 in the same manner as described above with respect to the lighting device 102 of FIG. 1. The electrical power is provided to the lighting device 302 via the line connection 116 when the switch 104 is in an on-position, and the AC power is disconnected from the lighting device 302 when the switch 104 is in an off-position.

In some example embodiments, the lighting device 302 operates in substantially the same manner as described above with respect to the lighting device 102. To illustrate, the control device 306 may correspond to the control device 112, and the LED driver 304 may correspond to the LED driver 108 with the control device 112 integrated therein. The LED driver 304 generates the output power provided to the light source 110 over a connection 308 when the switch 104 is in the on-position allowing power to be provided to the LED driver 308. The LED driver 304 may also provide power to the auxiliary device 124 via an electrical connection 310 depending on the toggle sequence of the switch 104. For example, the control device 306 may detect the toggling of the switch 104 and the duration of the switch 104 in the on-position by detecting the toggling and duration of a power controlled by the switch 304. To illustrate, the control device 306 may detect the toggling and duration of a DC signal generated from an AC power signal received by the LED driver 304 via the connection 116. The control device 306 may control whether the driver 304 provides the power to the auxiliary device 124 and/or the operation mode of the auxiliary device 124 in a similar manner as described with respect to the control device 112 and the lighting device 102.

In some example embodiments, the control device 306 may perform the operations described above with respect to the control device 112 of FIG. 1 as well as operations of the LED driver 304 in providing power to the light source 110. For example, the control device 306 can control the amount of power provided to the light source 110, for example, based on a wirelessly received lighting command.

In some alternative embodiments, the lighting device 302 may include more than one auxiliary device that may be controlled by the control device 306 in a similar manner as the auxiliary device 124. In some alternative embodiments, the lighting device 102 may include other components instead of or in addition to the components shown in FIG. 3. In some example embodiments, one or more components of the system 300 and/or the device 302 may be omitted or integrated without departing from the scope of this disclosure. In some alternative embodiments, the control device 306 may operate on power provided by a battery that may be included in or external to the lighting device 302.

Figure 4:
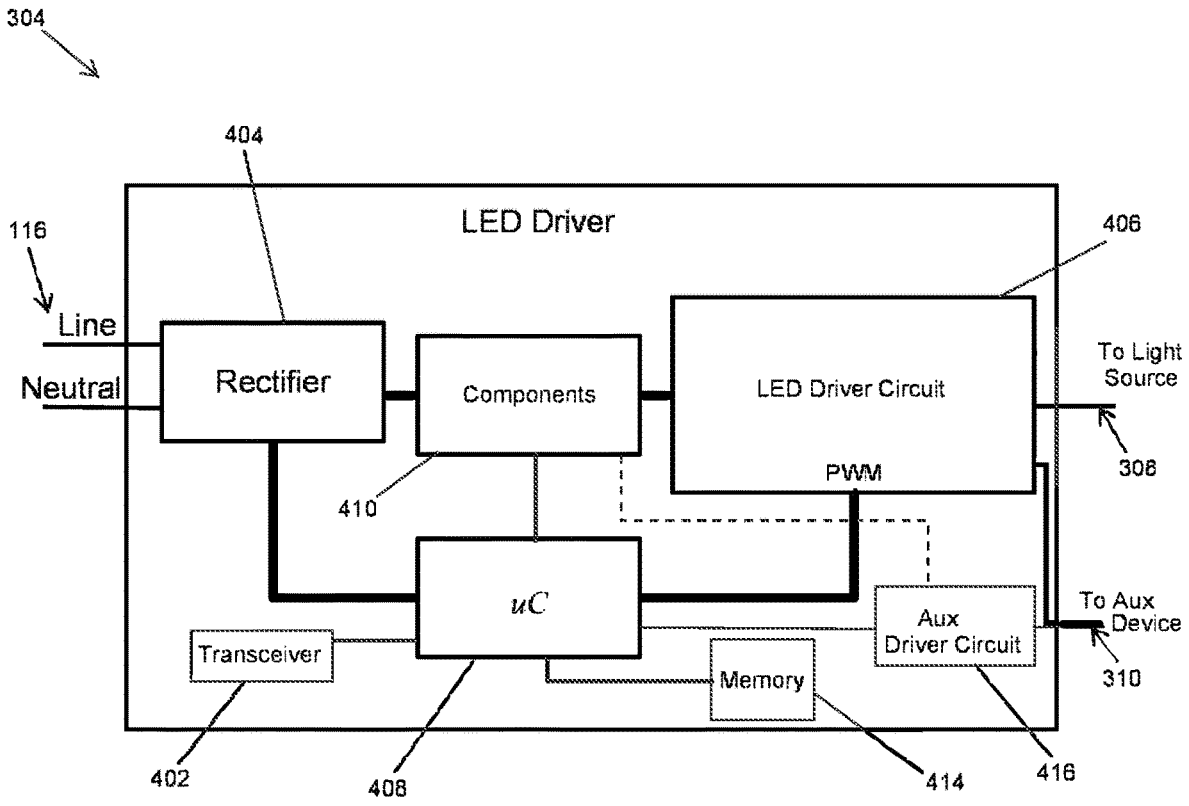
FIG. 4 illustrates the LED driver of the lighting device of FIG. 3 according to an example embodiment.

FIG. 4 illustrates the LED driver 304 of the lighting device 302 of FIG. 3 according to an example embodiment. Referring to FIGS. 3 and 4, the LED driver 304 includes a wireless transceiver or receiver 402, a rectifier circuit 404, and an LED driver circuit 406. In some example embodiments, the control device 306 may include a controller 408 (e.g., a microcontroller) and a memory device 414 (e.g., an SRAM or a Flash memory). For example, software code that is executable by the controller 408 may be stored in the memory device 414. The driver 308 may also include other driver components 410 and an auxiliary driver circuit 416.

In some example embodiments, the controller 408 controls the driver circuit 406 to control the power provided to the light source 110. For example, the controller 408 may control the power provided to the light source 110 based on a lighting control instruction received via the transceiver 402. The controller 408 may also detect when AC power on the connection 116 becomes available to the LED driver 304. For example, the controller 408 may include an analog-to-digital converter that converts the output of the rectifier circuit 404 to a digital signal that is processed by the controller 408 to determine when the AC power becomes available. Because the AC power is controlled by the switch 104, detecting the availability of the AC power may correspond to detecting whether the switch is toggled on. The controller 408 may detect a sequence of toggles of the switch 104 including one or more time durations that the switch 104 is in the on-position and may control (e.g., turn on or off) the auxiliary device 124 accordingly by controlling the driver circuit 406 and/or the driver circuit 416.

Because whether the auxiliary device 124 should be turned on or off may depend on whether the auxiliary device 124 was on or off when the switch 104 was previously in the on-position (i.e., AC power was previously available), the controller 408 may store and retrieve such information in/from the memory device 414. The controller 408 may also store and retrieve other information including the toggle sequences and time durations in/from the memory device 414.

In some alternative embodiments, the LED driver 304 may include more or fewer components as well as different components without departing from the scope of this disclosure. In some alternative embodiments, one or more components of the LED driver 304 may be integrated into another component of the LED driver 304 without departing from the scope of this disclosure.

Figure 5:
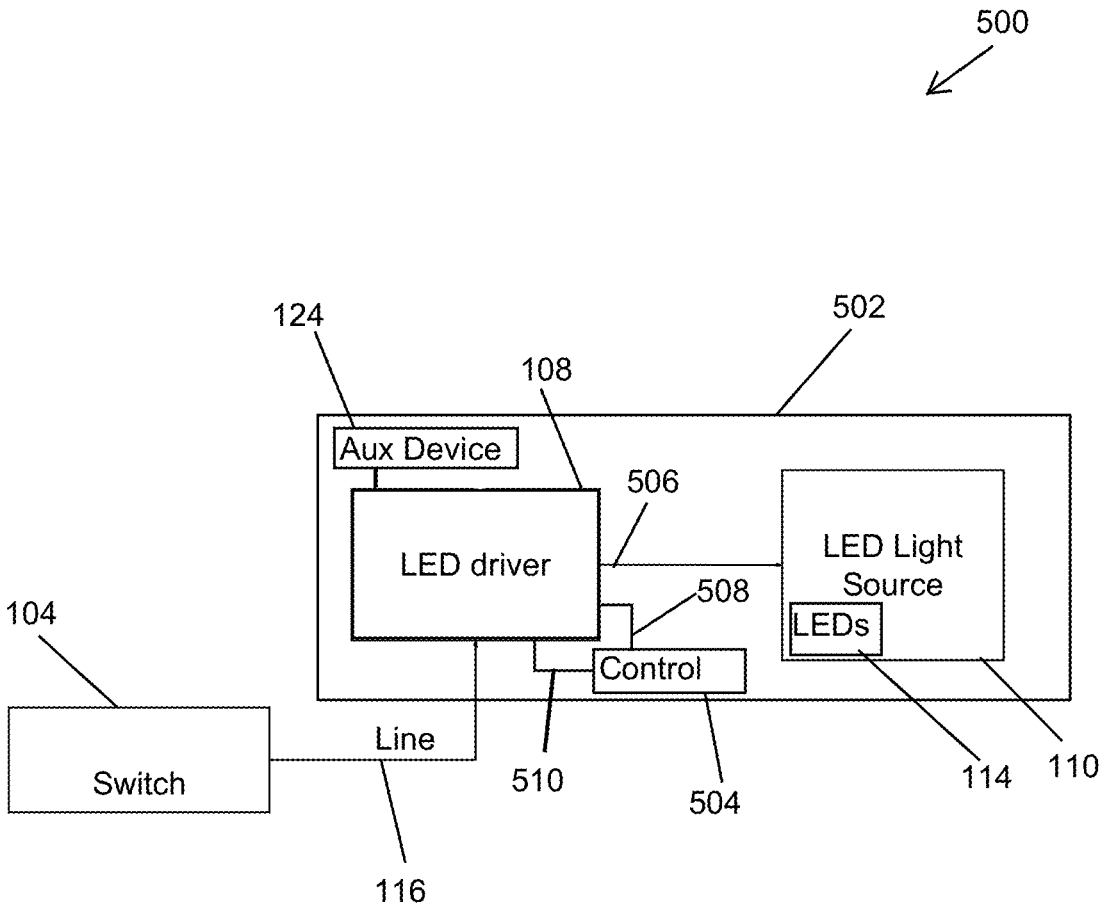
FIG. 5 illustrates a lighting system including a lighting device with an integrated auxiliary device controllable based on availability of power according to another example embodiment.

FIG. 5 illustrates a lighting system 500 including a lighting device 502 with the integrated auxiliary device 124 controllable based on availability of power according to another example embodiment. The system 500 also includes the switch 104. The switch 104 may control the availability of AC power to the lighting device 502 in the same manner described above with respect to FIGS. 1-4.

In some example embodiments, the lighting device 502 includes the LED driver 108, a control device 504, and the light source 110. The control device 504 operates to control the auxiliary device 124 based on the toggling of the switch 104 as described above with respect to the control devices 112 and 306. To illustrate, the LED driver 108 may receive the AC power when the switch 104 is in the on-position and generate a first output power from the AC power that is provided to the light source 110 on a connection 506. The LED driver 108 may also generate a second output power from the AC power and provide the second output power to the control device 504 via a connection 508. The control device 504 may detect when the second power becomes available and, upon detecting the second power becoming available, the control device 504 may indicate to the LED driver 108, via a connection 510, whether to provide an output power to the auxiliary device 124 and/or to provide a control signal to the auxiliary device 124. Because the second output power is generated from the AC power when the switch 104 is in the on-position, the availability of the second output power indicates that the switch 104 being in the on-position.

In some example embodiments, the control device 504 may store information in a non-volatile memory (e.g., an EEPROM or Flash memory). For example, the information stored in the memory device may indicate, for example, the detection of the availability of the second power received via the connection 508, the duration of time that the second power remained available or whether the second power was available for at least a threshold time period (e.g., 2 seconds), whether power was provided to the auxiliary device 124 when the second output power was previously available for at least a threshold time period, etc. Executable software code may also be stored in the memory device.

In some example embodiments, the control device 504 may also control whether the auxiliary device 124 is turned on, off, in a particular mode, etc. based on a wirelessly received control command, a programmed schedule, etc. For example, the control device 504 may control the auxiliary device 124 based on wireless received commands through the driver 108.

In some alternative embodiments, the lighting device 502 may include more than one auxiliary device that may be controlled by the control device 506 in a similar manner as the auxiliary device 124. In some alternative embodiments, the lighting device 502 may include other components instead of or in addition to the components shown in FIG. 5. In some example embodiments, one or more components of the system 500 and/or the device 502 may be omitted or integrated without departing from the scope of this disclosure. In some alternative embodiments, the control device 504 may operate on power provided by a battery that may be included in or external to the lighting device 502.

Figure 6:
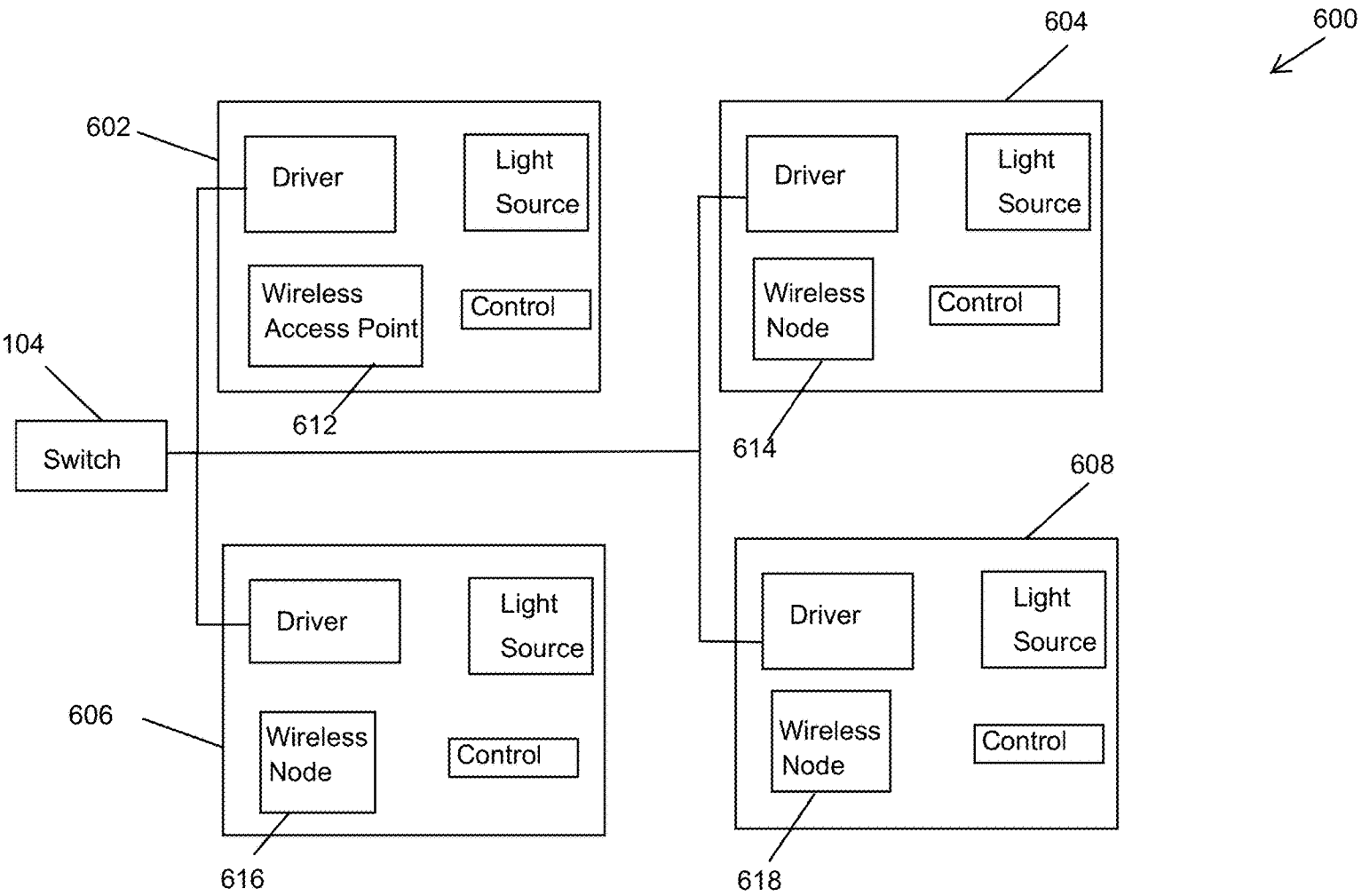
FIG. 6 illustrates a lighting system including multiple lighting devices with an integrated auxiliary device controllable based on availability of power according to an example embodiment.

FIG. 6 illustrates a lighting system 600 including multiple lighting devices with an integrated auxiliary device controllable based on availability of power according to an example embodiment. In some example embodiments, the lighting system 600 includes lighting devices 602, 604, 606, 608 and a switch 104 that control the availability of electrical power to the lighting devices 602, 604, 606, 608. For example, each of the lighting devices 602, 604, 606, 608 may be a recessed or another type of lighting fixture.

In some example embodiments, the lighting device 602 may correspond to the lighting device 102, where the auxiliary device 124 corresponds to the wireless access point 612. The lighting device 604 may correspond to the lighting device 102, where the auxiliary device 124 corresponds to a wireless node device 614. The lighting device 606 may correspond to the lighting device 102, where the auxiliary device 124 corresponds to a wireless node device 616. The lighting device 608 may correspond to the lighting device 102, where the auxiliary device 124 corresponds to a wireless node device 618. In some alternative embodiments, the lighting devices 602, 604, 606, 608 may correspond to the lighting devices 302 or 502, or a mixture of the lighting devices 102, 302, and 502.

In some example embodiments, the wireless access point 612 of the lighting device 602 may be configured to operate as a wireless network access point to the wireless nodes 614, 616, 618. For example, the lighting devices 604, 606, 608 may be controlled through the lighting device 602. To illustrate, a wireless or wired control device may transmit lighting control commands to the lighting devices 604, 606, 608 through the wireless access point 612 of the lighting device 602 after the wireless access point 612 is configured to wirelessly communicate with the wireless node devices 614, 616, 618, and after the wireless node devices 614, 616, 618 are configured to wirelessly communicate with the wireless access point 612. For example, the wireless access point 612 and the wireless node devices 614, 616, 618 may be capable of wirelessly communicating in compliance with one or more wireless communication standards (e.g., Wi-Fi, ZigBee, BLE, a proprietary standard, etc.).

In some example embodiments, wireless communications may be initiated between the wireless access point 612 and the wireless node devices 614, 616, 618 in response to a particular sequence of one or more toggles of the switch 104. For example, the respective control device of each of the lighting devices 602, 604, 606, 608 may detect the particular sequence based on the toggling and duration of AC power controlled by the switch 104. Upon detection of the particular sequence by the control device of the lighting device 602, the wireless access point 612 may attempt to establish wireless communication with wireless node devices. Upon detection of the particular sequence by the respective control device of the lighting devices 604, 606, 608, the respective wireless node devices 614, 616, 618 may attempt to establish wireless communication with the wireless access point 612. After wireless communication is established between the wireless access point 612 and the wireless node devices 614, 616, 618, the lighting devices 604, 606, 608 may be controlled through the lighting device 602, which may be connected to a lighting control device via a wired connection (e.g., an Ethernet cable) or wirelessly.

In some alternative embodiments, the system 600 may include more or fewer lighting devices than shown without departing from the scope of this disclosure. In some alternative embodiments, the lighting devices of the system 600 may include other auxiliary devices that are controlled based on a different toggle sequence of the switch 104 without departing from the scope of this disclosure.

Figure 7:
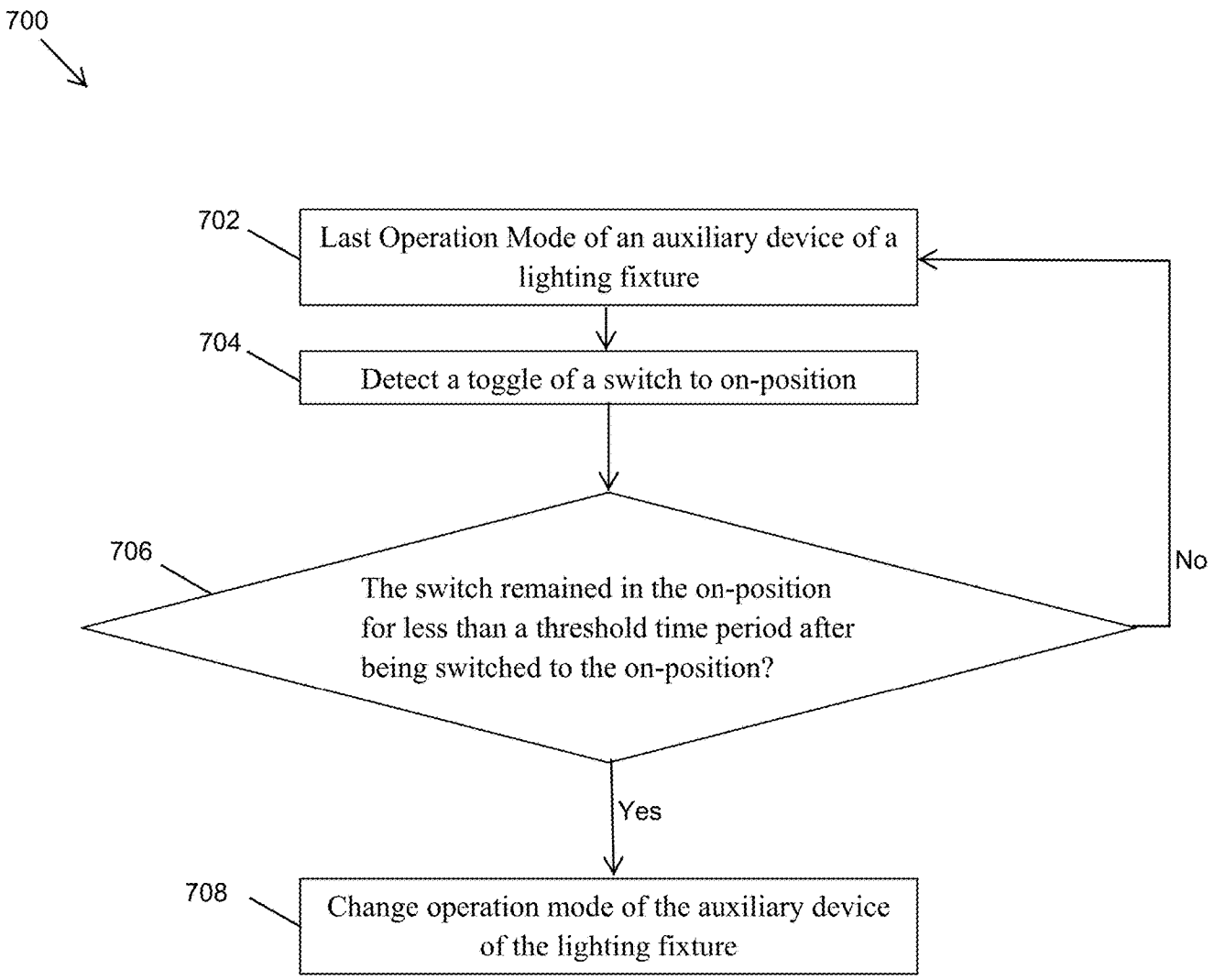
FIG. 7 illustrates a method of controlling an auxiliary device of a lighting device based on availability of power according to an example embodiment.

FIG. 7 illustrates a method 700 of controlling an auxiliary device of a lighting device based on availability of power according to an example embodiment. Referring to FIGS. 1-7, in some example embodiments, the method 700 starts at step 702 with the latest operation mode (i.e., the last operation mode looking back at step 704) of the auxiliary device 124 of a lighting fixture (e.g., the lighting device 102, 306, 504). For example, if the switch 104 is in the on position, where the AC power is available to the lighting device 102, and the auxiliary device 124 is powered on, the latest operation mode of the auxiliary device 124 may be that the auxiliary device 124 is "powered on." As another example, if power is currently available to the lighting device 102 and the auxiliary device 124 is powered off, the latest operation mode of the auxiliary device 124 may be that the auxiliary device 124 is "powered off." As yet another example, if power is currently unavailable to the lighting device 102 (i.e., the switch is off) and the auxiliary device 124 was powered on when the AC power controlled by the switch 104 was previously available to the lighting device 102 for at least a threshold time period, the latest operation mode of the auxiliary device 124 may be that the auxiliary device 124 is "powered on." At step 704, the control device (e.g., the control device 112, 306, 504) may detect whether the switch 104 is toggled to the on-position. For example, the switch 104 may be toggled off and toggled back on, and the control device 112 may detect the toggle of the switch 104 to on or both to off and on in a similar manner as described above.

At step 706, the control device may determine whether the switch 104 remained in the on-position for less than a threshold time period after being toggled to the on-position. For example, if the control device determines that the switch 104 remained on for longer than the threshold time period (e.g., 4 seconds), the control device (e.g., the control device 112, 306, 504) may maintain the last (i.e., latest) operation mode of the auxiliary device 124 present at step 702. If the control device determines that the switch 104 remained on for less than the threshold time period, at step 708, the control device may turn off the auxiliary device 124 if the auxiliary device 124 was on during last (i.e., latest) operation mode present at step 702 and may turn on the auxiliary device 124 if the auxiliary device 124 was off during last (i.e., latest) operation mode of the auxiliary device 124 present at step 702. Alternatively, if the switch 104 remains on for less than the threshold time period, at step 708, the control device may set the operation mode of the auxiliary device 124 to a particular corresponding operation mode (e.g., a microphone disable or mute mode of a smart speaker).

In some example embodiments, the method 700 may include detecting multiple toggles of the switch 104 to the on-position and to the off-position, where the action taken by the control device at step 708 depends on the number of toggles and/or the duration of time that the switch 104 remains in the on-position after one or more of the toggles of the switch 104 to the on-position. For example, in FIG. 7, step 704 may be repeated after the step 706 and may be followed by another step 706. The method 700 may include a number of such repetitions of the steps 704, 706 prior to the step 708 without departing from the scope of this disclosure.

In some alternative embodiments, the control device may change the operation mode of the auxiliary device 124 if the switch 104 remains on for longer than a first threshold time period and less than a second threshold time period depending on the last/latest operation mode of the auxiliary device 124. In some alternative embodiments, the control device may change the operation mode of the auxiliary device 124 if the switch 104 remains on for longer than a first threshold time period and less than a second threshold time period depending on the last/latest operation mode of the auxiliary device 124 regardless of the last/latest operation mode of the auxiliary device 124. In some alternative embodiments, the method 700 may include other steps without departing from the scope of this disclosure.

Figure 8:
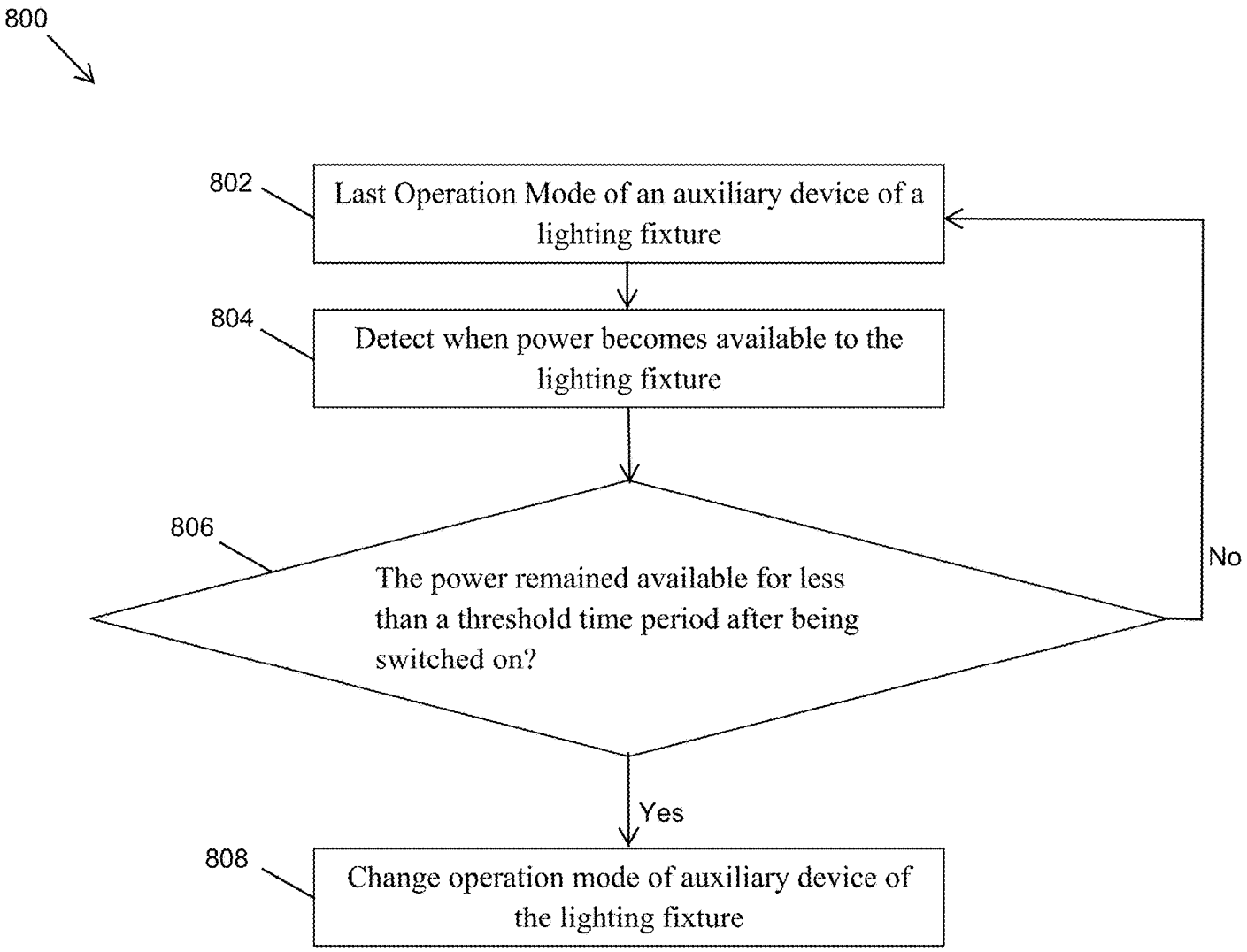
FIG. 8 illustrates a method of controlling an auxiliary device of a lighting device based on availability of power according to another example embodiment.

FIG. 8 illustrates a method 800 of controlling an auxiliary device of a lighting device based on availability of power according to another example embodiment. In some example embodiments, the method 800 corresponds to the method 700 described with respect to detection of toggle sequences of the switch 104. Referring to FIGS. 1-8, in some example embodiments, the method 800 starts at step 802 with the latest operation mode (i.e., the last operation mode looking back at step 804) of the auxiliary device 124 of a lighting fixture (e.g., the lighting device 102, 306, 504). For example, if the AC power is available to the lighting device 102, and the auxiliary device 124 is powered on, the latest operation mode of the auxiliary device 124 may be that the auxiliary device 124 is "powered on." As another example, if power is currently available to the lighting device 102 and the auxiliary device 124 is powered off, the latest operation mode of the auxiliary device 124 may be that the auxiliary device 124 is "powered off" As yet another example, if power is currently unavailable to the lighting device 102 and the auxiliary device 124 was powered on when the AC power controlled was previously available to the lighting device 102 for at least a threshold time period, the latest operation mode of the auxiliary device 124 may be that the auxiliary device 124 is "powered on." At step 804, the control device (e.g., the control device 112, 306, 504) may detect whether the AC power or equivalently whether power from the driver (e.g., the driver 108) is available. For example, the AC power provided to the lighting device 102 may be turned off and turned back on, and the control device 112 may detect the switching of the power to on or both to off and on in a similar manner as described above.

At step 806, the control device may determine whether the power remained on for less than a threshold time period after being turned on as detected at step 804. For example, if the control device determines that the power remained on for longer than the threshold time period (e.g., 6 seconds), the control device (e.g., the control device 112, 306, 504) may maintain the last (i.e., latest) operation mode of the auxiliary device 124 present at step 802. If the control device determines that the power remained on for less than the threshold time period, at step 808, the control device may turn off the auxiliary device 124 if the auxiliary device 124 was on during last (i.e., latest) operation mode present at step 802 and may turn on the auxiliary device 124 if the auxiliary device 124 was off during last (i.e., latest) operation mode of the auxiliary device 124 present at step 802. Alternatively, if the power remains on for less than the threshold time period, at step 808, the control device may set the operation mode of the auxiliary device 124 to a particular corresponding operation mode (e.g., a sensing off mode of a sensor).

In some example embodiments, the method 800 may include detecting multiple switches of the AC power or other power derived from the AC power to on and off, where the action taken by the control device at step 808 depends on the number of power switches and/or the duration of time that the power remains on after one or more of the switches of the power to on. For example, in FIG. 8, step 804 may be repeated after the step 806 and may be followed by another step 806. The method 800 may include a number of such repetitions of the steps 804, 806 prior to the step 808 without departing from the scope of this disclosure.

In some alternative embodiments, the control device may change the operation mode of the auxiliary device 124 if the AC power remains on for longer than a first threshold time period and less than a second threshold time period depending on the last/latest operation mode of the auxiliary device 124. In some alternative embodiments, the control device may change the operation mode of the auxiliary device 124 if the AC power remains on for longer than a first threshold time period and less than a second threshold time period depending on the last/latest operation mode of the auxiliary device 124 regardless of the last/latest operation mode of the auxiliary device 124. In some alternative embodiments, the method 800 may include other steps without departing from the scope of this disclosure.

Figure 9:
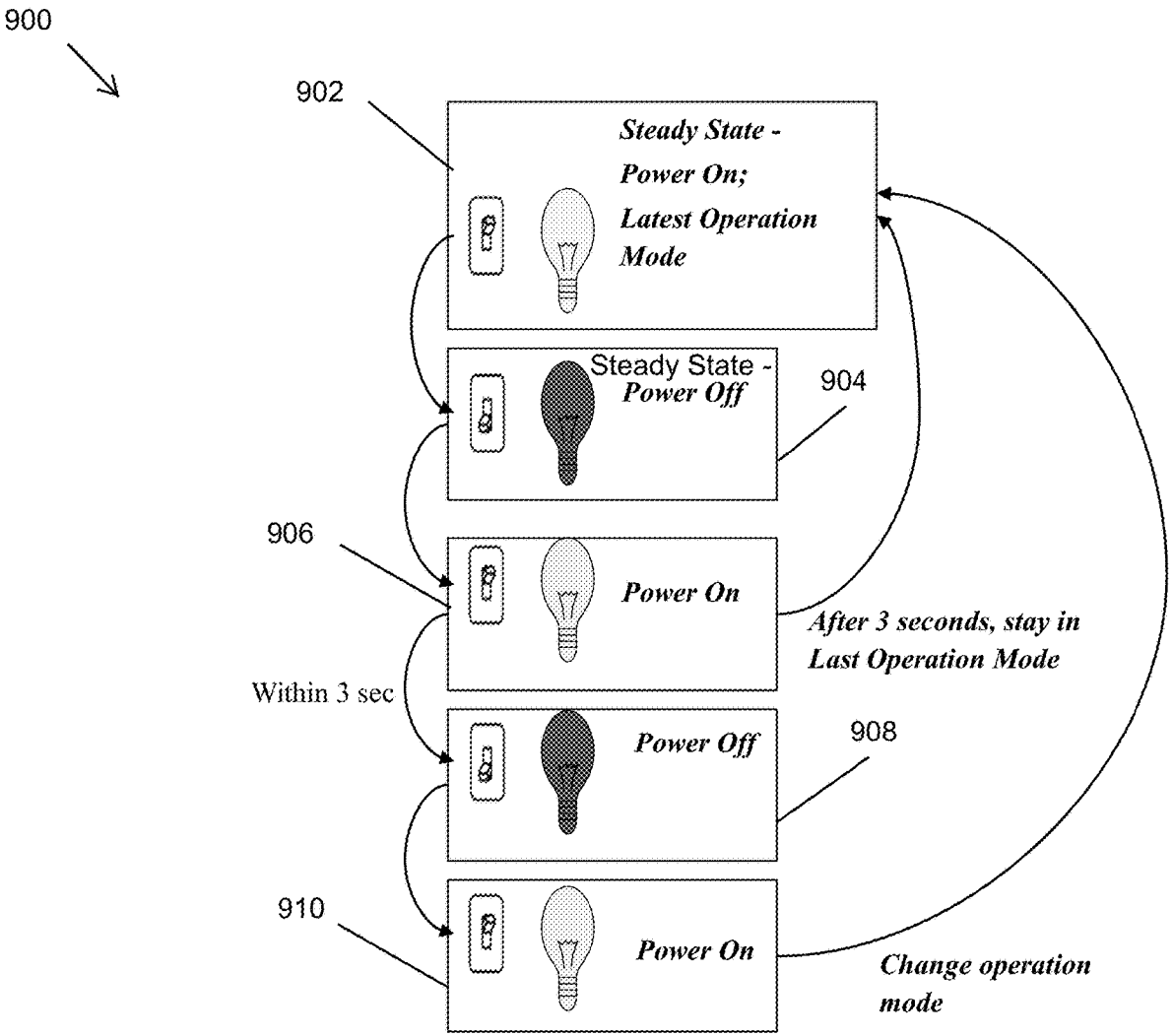
FIG. 9 illustrates steps of operations of a switch that controls power to a lighting device according to an example embodiment.

FIG. 9 illustrates steps of operations 900 of a switch that controls power to a lighting device according to an example embodiment. Referring to FIGS. 1-9, the operations 900 may start with a steady state of the switch 104 at a step 902, where the switch 104 is in the on-position and the electrical power (e.g., AC power) is provided to a lighting device (e.g., the lighting device 102). At step 902 of the operations 900 of the switch 104, the operation mode of the auxiliary device (e.g., the auxiliary device 124) may correspond to the latest operation mode of the auxiliary device as described with respect to the methods 700 and 800 and may have been set through the methods 700, 800, through the operation 900, by default, etc. At step 904, the switch 104 is toggled off from the on position at step 902. At step 906, the switch 104 is toggled back to the on-position from the off-position at step 904, for example, by a user. If the switch 104 remains in the on-position for longer than a threshold time period (e.g., 3 seconds) following the toggling of the switch to the on-position at step 906, the state of the auxiliary device 124 remains stays the same as the last/latest operation mode at the step 902. That is, the control device 112, 306, 504 does not change the operation mode of the auxiliary device 124. The state of the switch 104 at step 106 also returns to the steady state of the operations 900 of the switch 104 at step 902. If the switch 104 is toggled to the off-position at step 908 from the on-positon at step 906 within the threshold time period, when the switch 104 is toggled back to the on-position at step 910, the control device (e.g., the control device 112) changes the operation mode of the auxiliary device 124 to on, off, or another mode as described above. From the step 910, the steps of the operations 900 continue back at the step 902 with new operation mode of the auxiliary device 124 as the latest operation mode of the auxiliary device 124.

In some alternative embodiments, the operations 900 of the switch 104 may include other toggles of the switch 104. In some alternative embodiments, the threshold time period may be shorter or longer than 3 seconds without departing from the scope of this disclosure.

Figure 10:
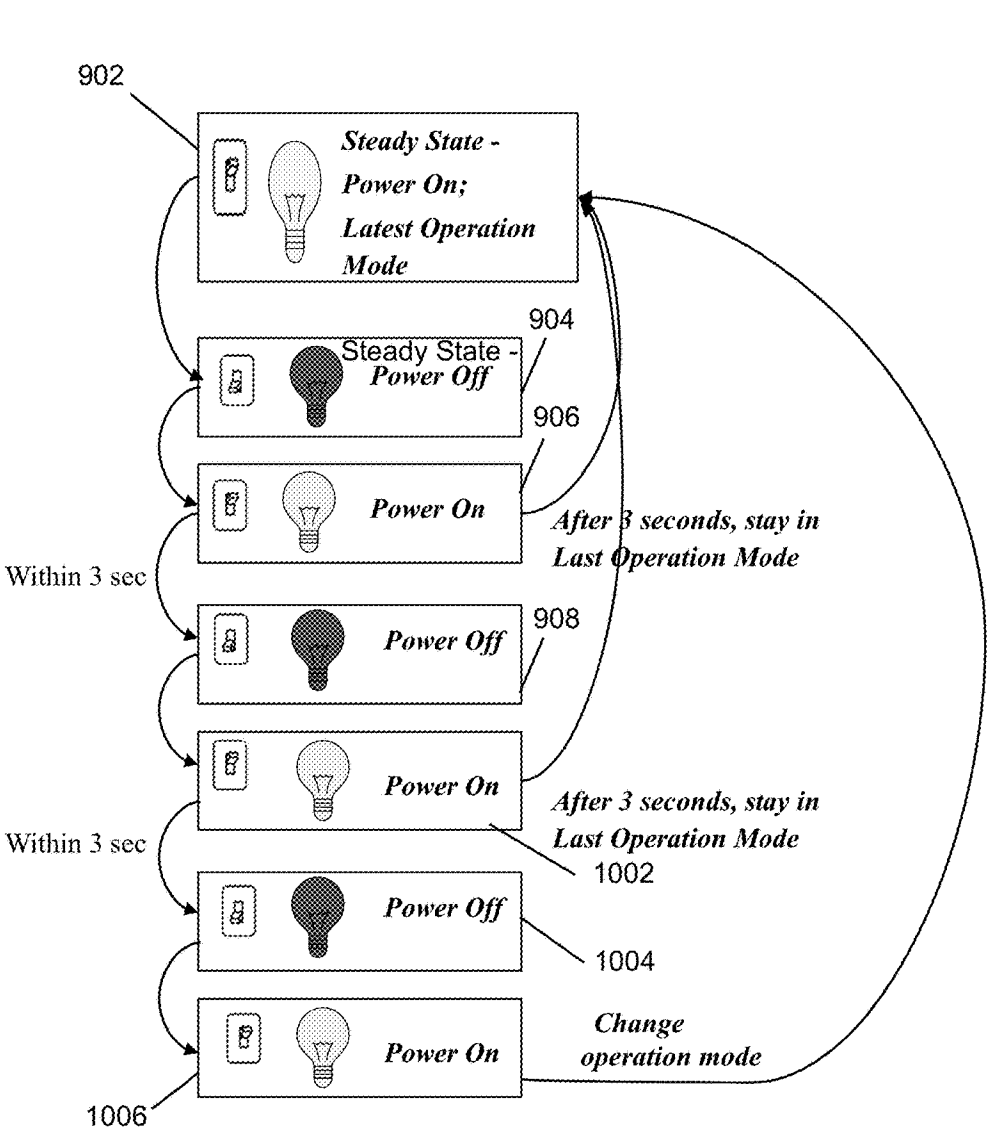
FIG. 10 illustrates steps of operations of a switch that controls power to a lighting device according to an example embodiment.

FIG. 10 illustrates steps of operations 1000 of a switch that controls power to a lighting device according to an example embodiment. Referring to FIGS. 1-10, in FIG. 10, the steps 902-908 correspond to the steps 902-908 of FIG. 9. Continuing from step 908, after the switch 104 is toggled to the on-position at step 1002 following step 908, the switch 104 may remain in the on-position for longer than a threshold period resulting in the return to the steady state at step 902 without changing the operation mode of the auxiliary device. If the switch 104 is toggled to the off-position at step 1004 from the on-positon at step 1002 within the threshold time period, when the switch 104 is toggled back to the on-position at step 1006, the control device (e.g., the control device 112) changes the operation mode of the auxiliary device 124 to on, off, or another mode as described above. From the step 1006, the steps of the operations 1000 continue back at the step 902 with a new operation mode of the auxiliary device 124 as the latest operation mode of the auxiliary device 124.

In some alternative embodiments, the threshold time periods may be different from each other at the different steps of the operations of the switch. In some alternative embodiments, the operation 1000 may include more toggles of the switch, where each toggle is checked against a respective threshold time period that may be the same or different from other threshold time periods.

Figure 11:
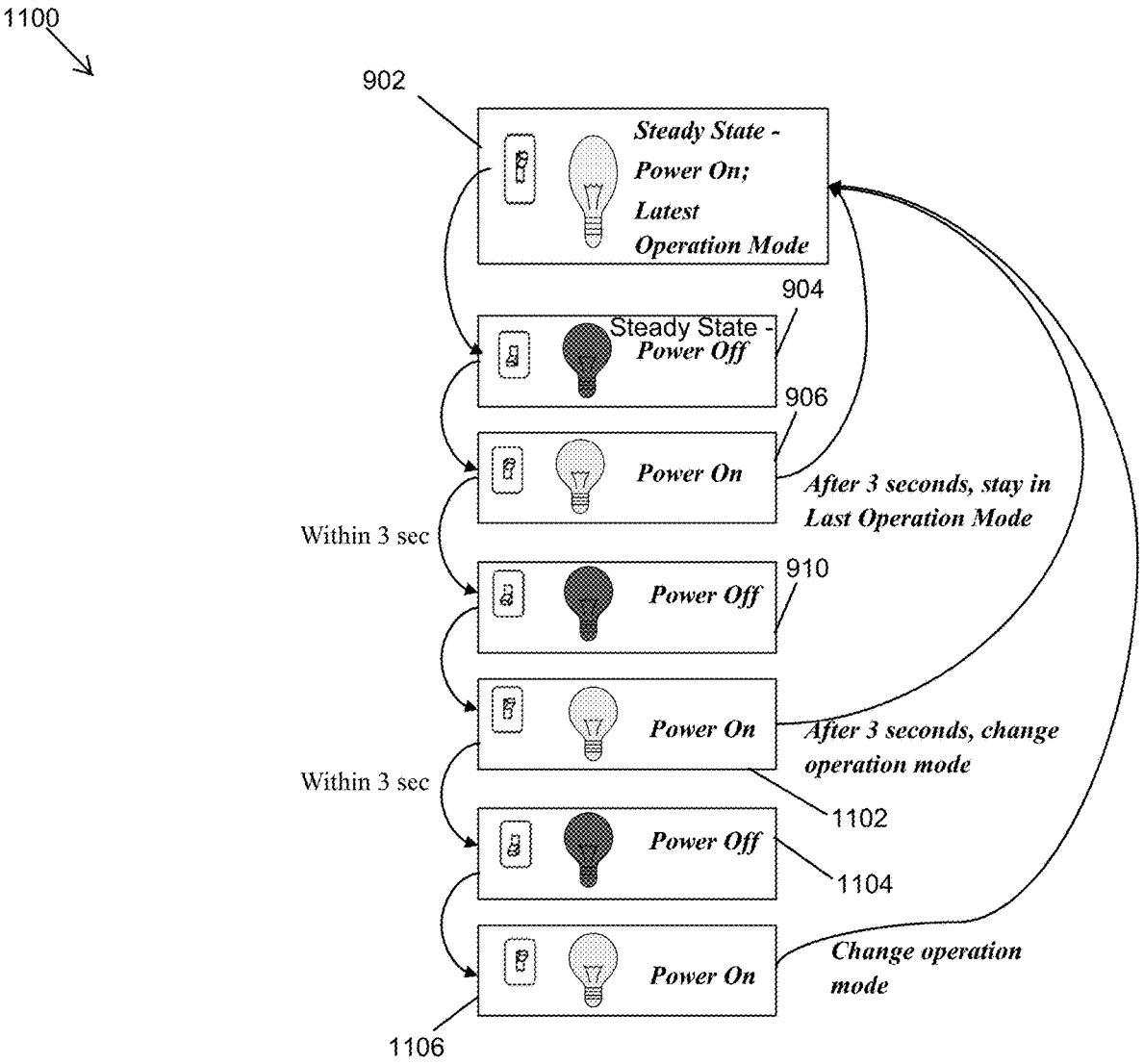
FIG. 11 illustrates steps of operations of a switch that controls power to a lighting device according to an example embodiment.

FIG. 11 illustrates steps of operations 1100 of a switch that controls power to a lighting device according to an example embodiment. Referring to FIGS. 1-9 and 11, in FIG. 11, the steps 902-908 correspond to the steps 902-908 of FIG. 9. Continuing from step 908, after the switch 104 is toggled to the on-position at step 1102 following step 908, the switch 104 may remain in the on-position for longer than a threshold period resulting in a return to the steady state at step 902. In contrast to the steps of FIG. 10, in FIG. 11, the operation mode of the auxiliary device 112 is also changed by the control device (e.g., the control device 112) if the switch 104 remains in the on-position for longer than a threshold period following the step 1102. If the switch 104 is toggled to the off-position at step 1104 from the on-positon at step 1102 within the threshold time period, when the switch 104 is toggled back to the on-position at step 1106, the control device (e.g., the control device 112) changes the operation mode of the auxiliary device 124 to on, off, or another mode as described above. From the step 1106, the steps of the operations 1100 continue back at the step 902 with a new operation mode of the auxiliary device 124 as the latest operation mode of the auxiliary device 124.

In some alternative embodiments, the threshold time periods may be different from each other at the different steps of the operations of the switch. In some alternative embodiments, the operation 1100 may include more toggles of the switch, where each toggle is checked against a respective threshold time period that may be the same or different from other threshold time periods.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a light source;

an auxiliary device; and a control device comprising a controller, the control device configured to detect toggles of a switch that controls availability of an input power to the lighting device including the light source, wherein the control device is configured to change an operation mode of the auxiliary device based on the toggles of the switch.

2. The lighting device of claim 1, wherein changing the operation mode of the auxiliary device includes turning on or turning off the auxiliary device.

3. The lighting device of claim 2, wherein changing the operation mode of the auxiliary device includes turning on the auxiliary device if the auxiliary device was off when the input power was last provided to the lighting device.

4. The lighting device of claim 2, wherein changing the operation mode of the auxiliary device includes turning off the auxiliary device if the auxiliary device was on when the input power was last provided to the lighting device.

5. The lighting device of claim 1, wherein changing the operation mode of the auxiliary device includes providing a control signal to the auxiliary device, wherein the control signal controls the operation mode of the auxiliary device.

6. The lighting device of claim 1, wherein changing the operation mode of the auxiliary device based on the toggles of the switch includes changing the operation mode of the auxiliary device if the switch is toggled to an off-position within a threshold time period after the switch is toggled to an on-position.

7. The lighting device of claim 1, wherein the auxiliary device includes a wireless access point device and wherein changing the operation mode of the auxiliary device includes initiating a wireless communication by the wireless access point device.

8. The lighting device of claim 1, wherein the auxiliary device includes one or more of a microphone, a sensor, a camera, or a smart speaker.

9. The lighting device of claim 1, wherein the auxiliary device includes a smart speaker and wherein changing the operation mode of the auxiliary device based on the toggles of the switch includes selecting an operation protocol of the smart speaker based on the toggles of the switch.

10. The lighting device of claim 1, wherein the control device is configured to detect the toggles of the switch based on detections of an output power generated by a driver of the lighting device from the input power provided to the lighting device.

11. A method of controlling an auxiliary device of a lighting device, the method comprising:

detecting, by a control device of the lighting device, a toggle of a switch to an off-position;

determining, by the control device of the lighting device, whether the switch is toggled to the off-position within a threshold time period after being toggled to an on-position; and changing the operation mode of the auxiliary device in response to determining that the switch is toggled to the off-position within the threshold time period after being toggled to the on-position.

12. The method of claim 11, wherein changing the operation mode of the auxiliary device includes turning on or turning off the auxiliary device.

13. The method of claim 12, wherein changing the operation mode of the auxiliary device includes turning on the auxiliary device if the auxiliary device was off when the input power was last provided to the lighting device.

14. The method of claim 12, wherein changing the operation mode of the auxiliary device includes turning off the auxiliary device if the auxiliary device was on when the input power was last provided to the lighting device.

15. The method of claim 11, wherein changing the operation mode of the auxiliary device includes providing a control signal to the auxiliary device and wherein the control signal controls the operation mode of the auxiliary device.

16. The method of claim 11, wherein the auxiliary device includes one or more of a microphone, a sensor, a camera, or a smart speaker.

17. The method of claim 11, wherein the control device is configured to detect the toggle of the switch based on detection of an output power generated by a driver of the lighting device from an input power provided to the lighting device and controlled by the switch.

18. A lighting system, comprising:

a first lighting device;

a second lighting device; and a switch that controls a power provided to the first lighting device and the second lighting device, wherein the first lighting device and the second lighting device each comprise:

a light source;

an auxiliary device; and a control device comprising a controller, the control device configured to detect toggles of the switch, wherein the control device is configured to change an operation mode of the auxiliary device based on the toggles of the switch.

19. The lighting system of claim 18, wherein changing the operation mode of the auxiliary device includes turning on or turning off the auxiliary device.

20. The lighting system of claim 18, wherein the auxiliary device of the first lighting device includes a wireless access point device, wherein the auxiliary device of the second lighting device includes a wireless node device, and wherein changing the operation mode of the auxiliary device of the first lighting device includes initiating, by the wireless access point device, a wireless communication with the auxiliary device of the second lighting device.

* * * * *